US005941041A

United States Patent [19]

Robinson et al.

[11] Patent Number: 5,941,041

[45] Date of Patent: Aug. 24, 1999

[54] PLAY STRUCTURE BUILDING PANEL

[75] Inventors: S. Eric Robinson, R. R. #2, Wiarton, Ontario, Canada, N0H 2T0; Dale A. George, Wiarton, Canada

[73] Assignee: S. Eric Robinson

[21] Appl. No.: 08/958,140

[22] Filed: Oct. 28, 1997

[51] Int. Cl.[6] ..... E04B 2/08

[52] U.S. Cl. ..... 52/591.4; 52/86; 52/245; 472/116; 482/37

[58] Field of Search ..... 52/245, 247, 591.4, 52/591.5, 86; 482/35–37, 51; 472/116, 117

[56] References Cited

U.S. PATENT DOCUMENTS

| | | | |
|---|---|---|---|
| 3,572,698 | 3/1971 | Greenly | 482/35 |
| 3,780,469 | 12/1973 | Hancovsky | 472/116 |
| 3,831,934 | 8/1974 | Hancovsky | 472/116 |
| 4,932,648 | 6/1990 | Ahrens | 472/116 |
| 5,125,877 | 6/1992 | Brewer | 482/7 |
| 5,254,058 | 10/1993 | Savigny | 482/37 |
| 5,256,116 | 10/1993 | Robinson | 482/37 |
| 5,334,098 | 8/1994 | Pope | 472/116 |
| 5,352,166 | 10/1994 | Chang | 482/37 X |
| 5,549,195 | 8/1996 | Aulagner | 482/37 X |
| 5,732,954 | 3/1998 | Strickler | 482/370 X |
| 5,815,989 | 10/1998 | Bennenk | 52/86 X |

*Primary Examiner*—Beth A. Aubrey
*Attorney, Agent, or Firm*—R. Craig Armstrong

[57] ABSTRACT

A play structure building panel comprising of integrally connected spaced-apart curved parallel inner and outer panel walls joined by two side edges and end two end edges. One of the side edges and at one of the end edges have an integral connection means extending therefrom to mate with complementary connection receiving means on an identical panel. Accordingly, one of the side edges and one of the end edges of the panel also have the complementary connections means to receive the connection means extending from another identical panel. Therefore, any number of the panels may be connected to other identical panels along any of the side or end edges.

19 Claims, 12 Drawing Sheets

PLAY STRUCTURE BUILDING PANEL

BACKGROUND OF THE INVENTION

This invention relates to playground equipment, and more particularly to a modular play structure building panel which can be connected to other identical panels to construct various play structures, such as tunnels, cylindrical towers, and walls.

Conventional playground equipment generally does not provide the versatility of this invention, in that it is not able to be assembled into as many different play structures utilizing identical panels.

SUMMARY OF THE INVENTION

The play structure building panel has spaced-apart curved parallel inner and outer panel walls joined by two side edges and end two end edges. Preferably, one of the side edges and one of the end edges have a connection means extending therefrom to mate with complementary connection receiving means on an identical panel. Accordingly, one of the side edges and one of the end edges of the panel also have the complementary connection means to receive the connection means extending from another identical panel. Therefore, any number of the panels may be connected to other identical panels along any of the side or end edges.

Additional features of the invention will be described or will become apparent in the course of the following detailed description.

BRIEF DESCRIPTION OF THE DRAWINGS

The invention will now be described in detail, with reference to the accompanying drawings by way of example only, in which.

DETAILED DESCRIPTION

Figure 1:
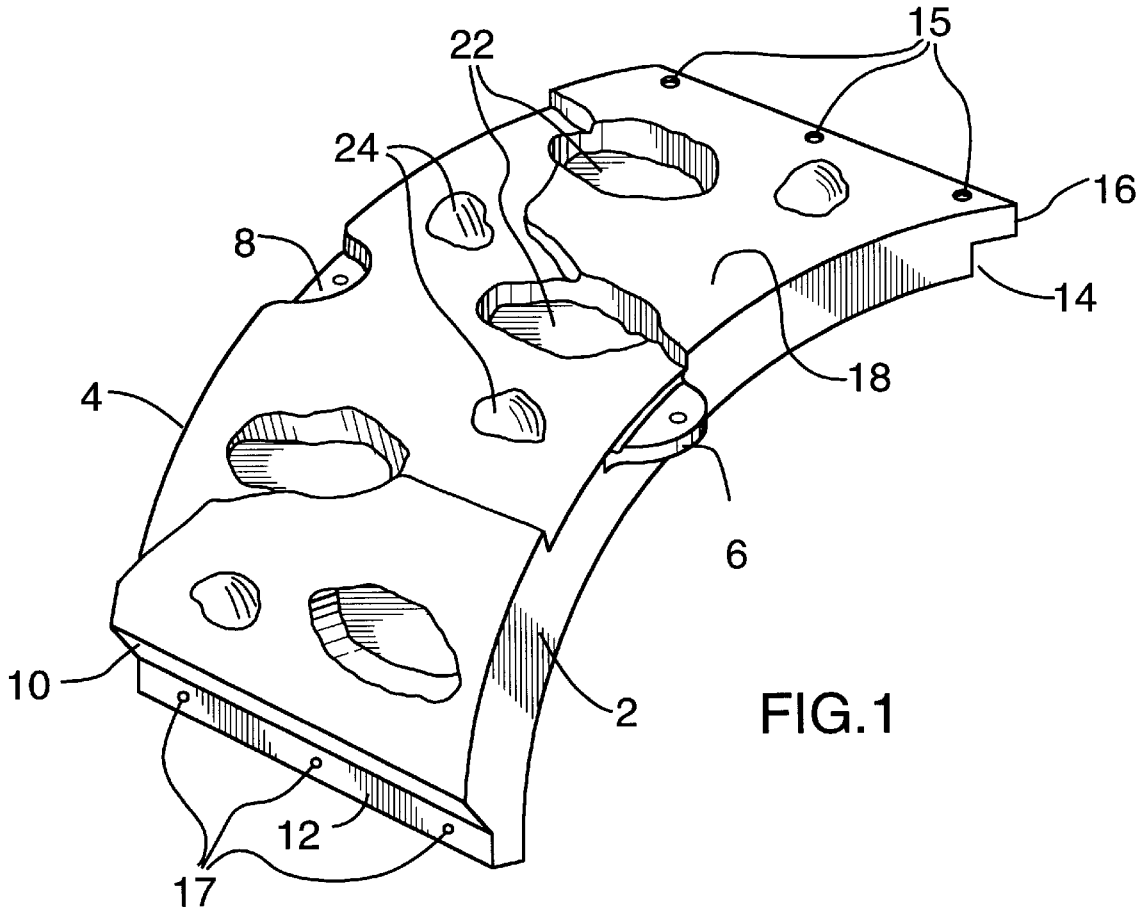
FIG. 1 is a perspective view of a typical panel of the invention.

As shown in FIGS. 1–4, an outer curved face 18 is integrally joined to a generally parallel inner curved face 20 spaced apart from the outer face. Each face contains a plurality of recesses 22 and plurality of projections 24 to partially simulate the appearance a rock face and to facilitate climbing. The outer and inner faces are joined, along their sides, by an integral curved side edge 2 from which protrudes a male fastening means 6, and an opposing integral parallel curved side edge 4 into which a complementary female fastening means 8 is recessed. The outer and inner faces are joined, along their end, by a linear end edge 10 from which protrudes an integral lower lip 12 and an opposing linear end edge 14 from which protrudes an integral upper lip 16. The lower lip has preferably three circular holes 15 oriented perpendicular to the lower lip with a diameter sufficient to accommodate a conventional bolt. Two of the holes are preferably located near each side of the panel and the third hole is located near the center. The upper lip 16 contains three holes 17 of identical diameters positioned to align with the three holes in the lower lip 12 when two identical panels are placed end to end, such that the upper lip of one panel overlaps the lower lip of an identical panel and the side edges of the two panels are aligned.

The entire panel is manufactured, preferably, from high strength plastic using a conventional rotational molding process.

Figure 7:
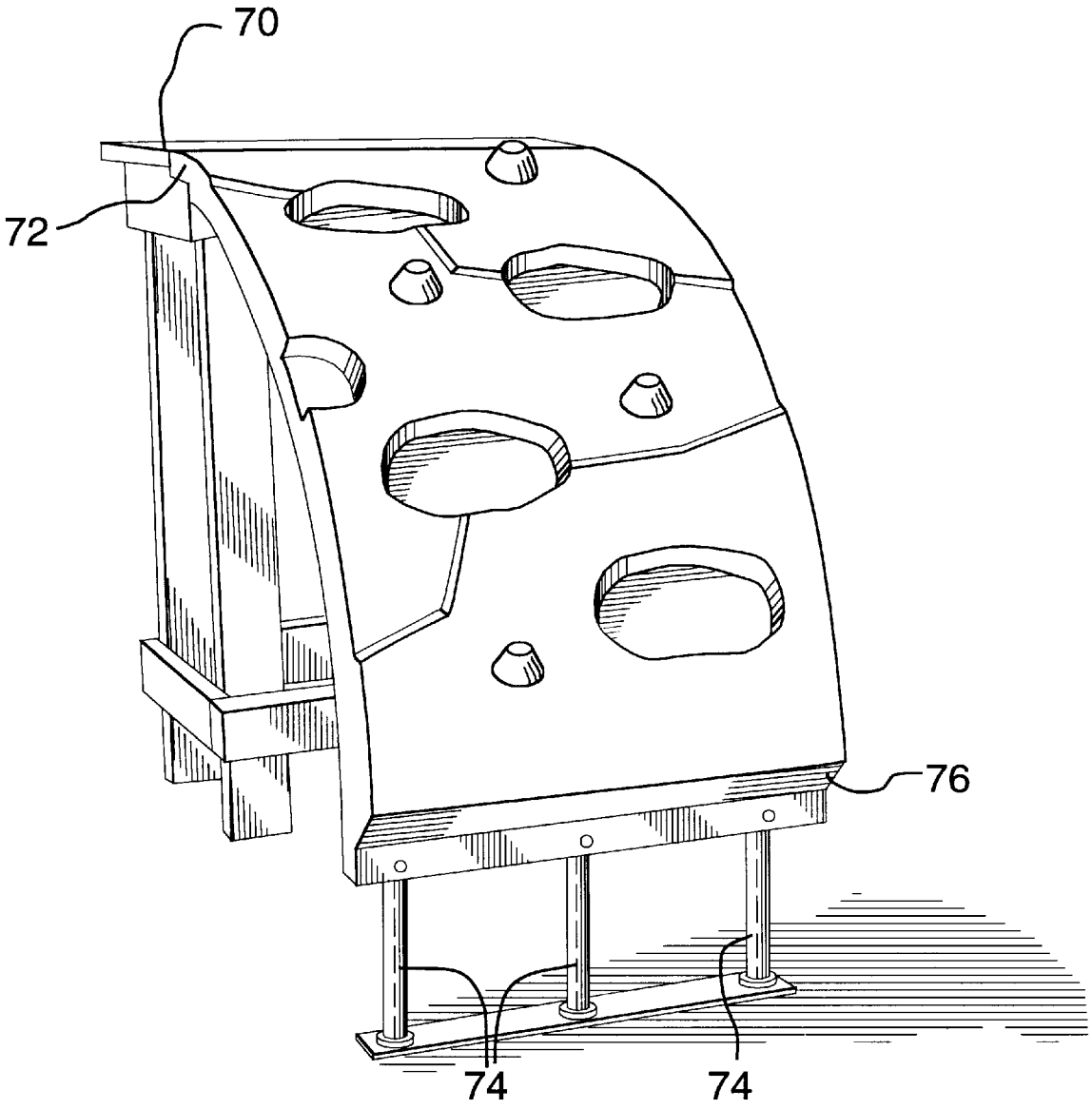
FIG. 7 is a perspective view of a slide-like configuration for playground equipment which the invention may be used to construct.

Preferably, the male portions 6 are omitted from edges of panels which are intended to be exposed, i.e. along the top of a wall, or along the side of a structure such as that shown in FIG. 7. This is readily achieved during the manufacturing process by inserting a plug in the mold to fill the space which would otherwise produce a male portion 6.

Figure 2:
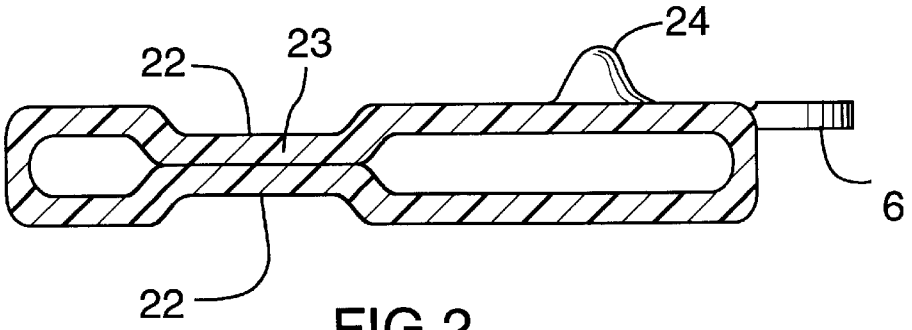
FIG. 2 is a cross-sectional view of the panel of FIG. 1.
Figure 4:
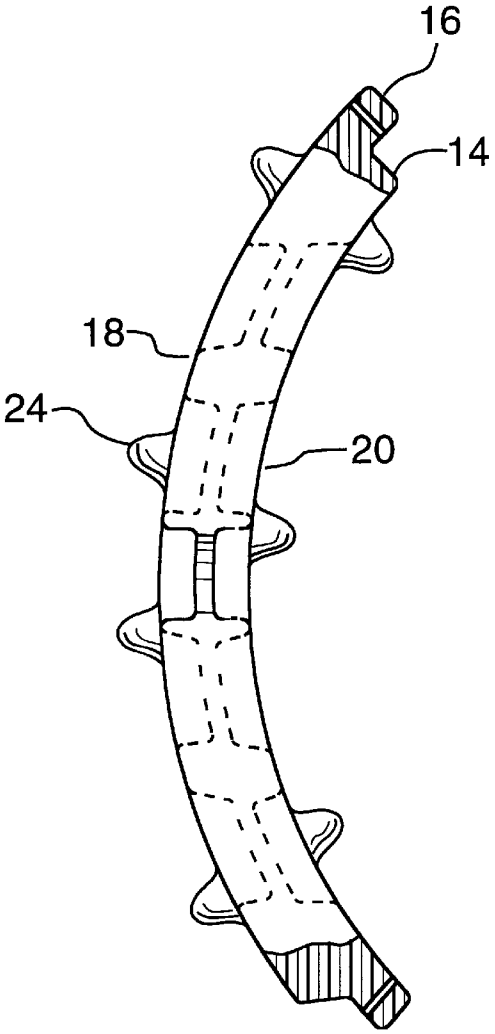
FIG. 4 is a side view of the panel.
Figure 3:
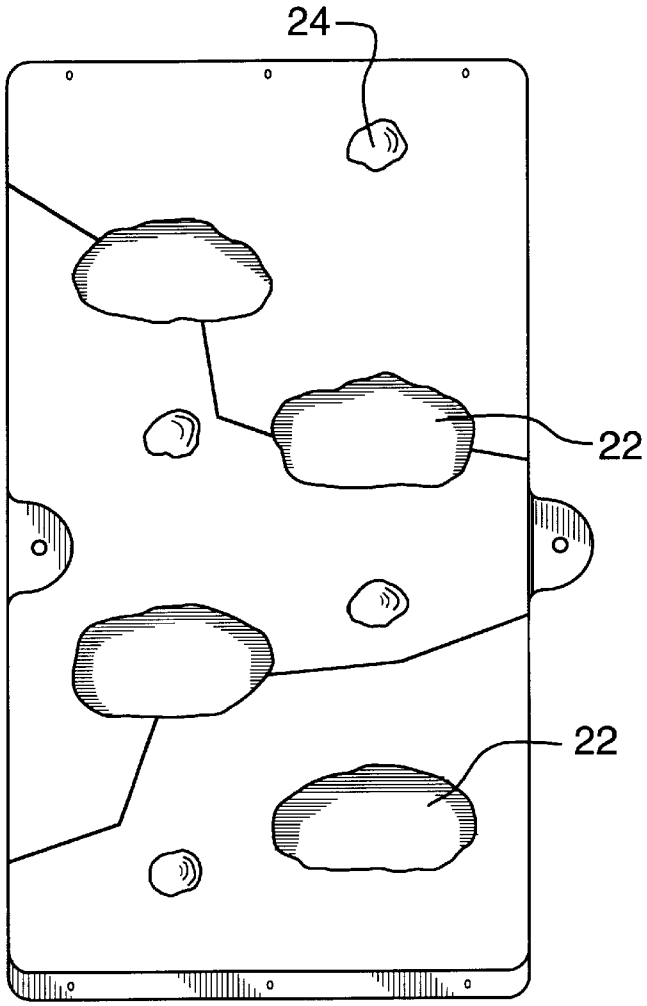
FIG. 3 is a plan view of the panel.

As shown in FIG. 2, the recesses 22 on the outer face are identically located and shaped, such that the bottom surface of a recess on the outer face identically contacts or preferably merges integrally with the bottom surface of a recess on the inner face. This is accomplished by ensuring that the clearances between the recesses in the mold are sufficiently small that the plastic material completely fills the space between the bottom surfaces of the corresponding recesses 22 to form one solid mass 23, thereby greatly increasing the structural strength and rigidity of the panel.

Figure 5:
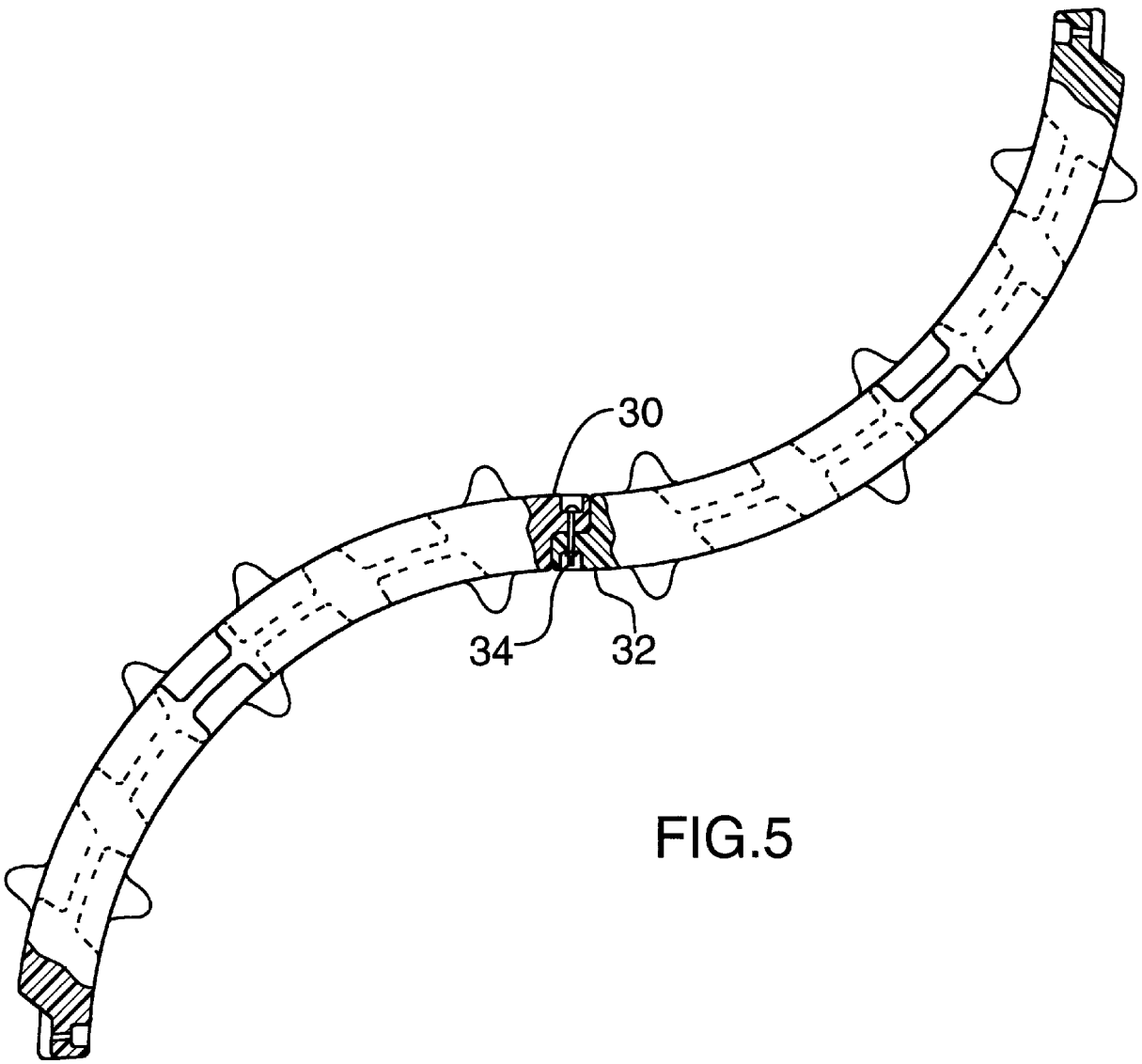
FIG. 5 is a side view of two panels with a cut-away view of the connection between two end edges of two identical panels.

As best shown in FIG. 5, a panel can be connected to another identical panel by placing the two panels end edge to end edge with the protruding upper lip of one panel 30 overlapping and resting on top of a lower lip 32 of an identical panel so that the three holes 15 of two identical panels are aligned. The panels are secured end edge to end edge by a conventional nut and bolt arrangement by passing maximum strength and stability.

The panel can also be connected side edge to side edge by inserting the male fastening means 6 of one panel into the recessed female fastening means 8 of another identical panel. The two panels are again connected by a conventional nut and bolt arrangement which penetrates aligned holes (not shown) in the male fastening means and the female fastening means.

Figure 6:
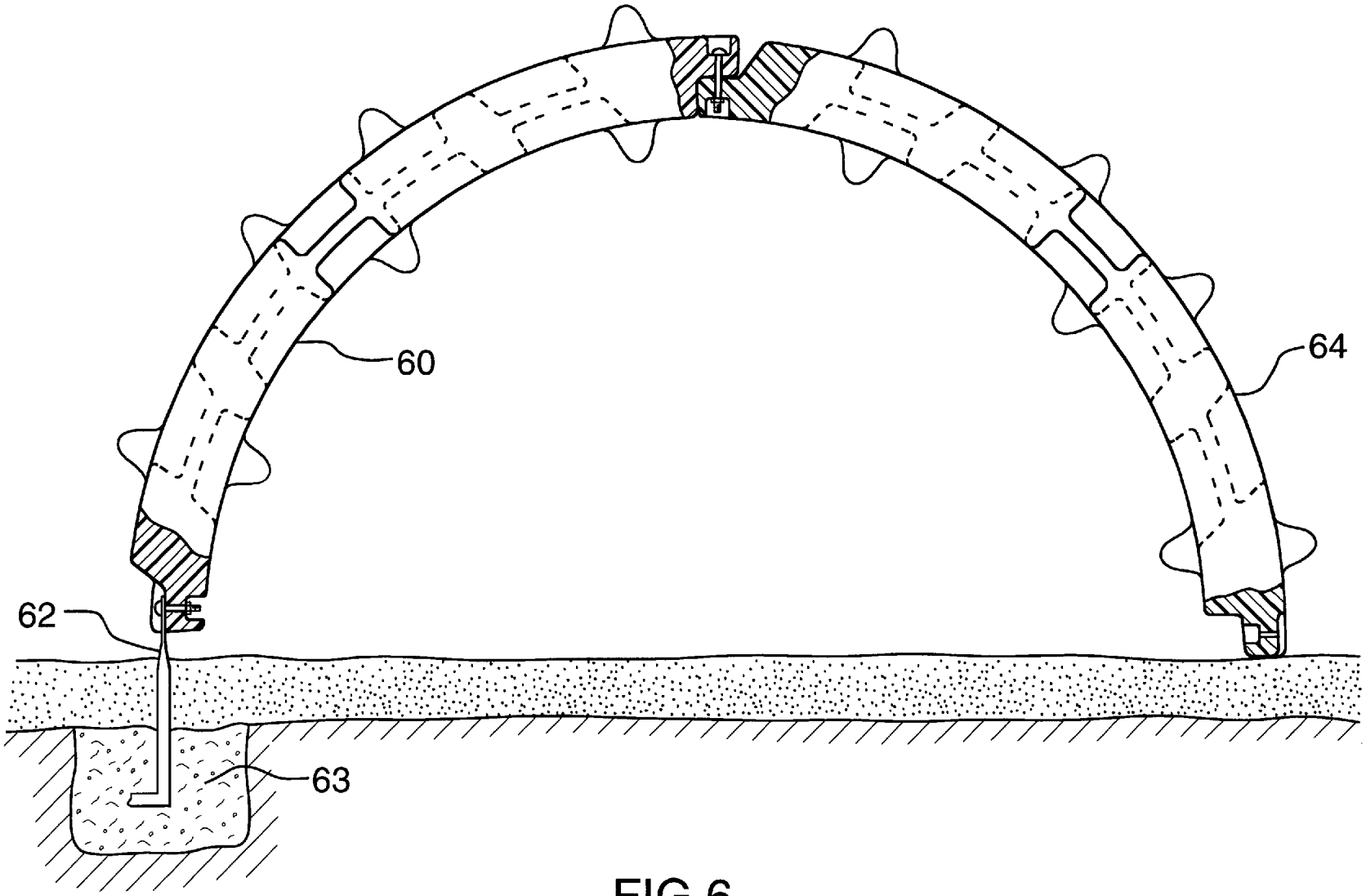
FIG. 6 is an elevation view of two identical panels formed into a tunnel shape with a cut-away view of the connection of the panel to an anchor post buried in concrete in the ground.

FIG. 6 illustrates a configuration where two identical panels are used to construct a semi-circular tunnel shape. At the crest of the tunnel shape, the two panels are connected to each other, end edge to end edge, as previously described. The lower lip of the end edge of the left panel 60 is connected by a conventional nut and bolt arrangement to the upper end of a metal anchor 62. The lower end of the anchor is preferably embedded in a concrete pad 63 buried in the ground. The bottom end of the right panel 64 rests on the surface of the ground and is not secured.

FIG. 7 illustrates an alternative configuration where a panel is connected to a wooden platform 70 at the upper end edge 72 and is connected to three anchor posts 74 at the lower end edge 76. The connections to the platform and the anchors can be made in a number of ways, as described above.

Figure 8:
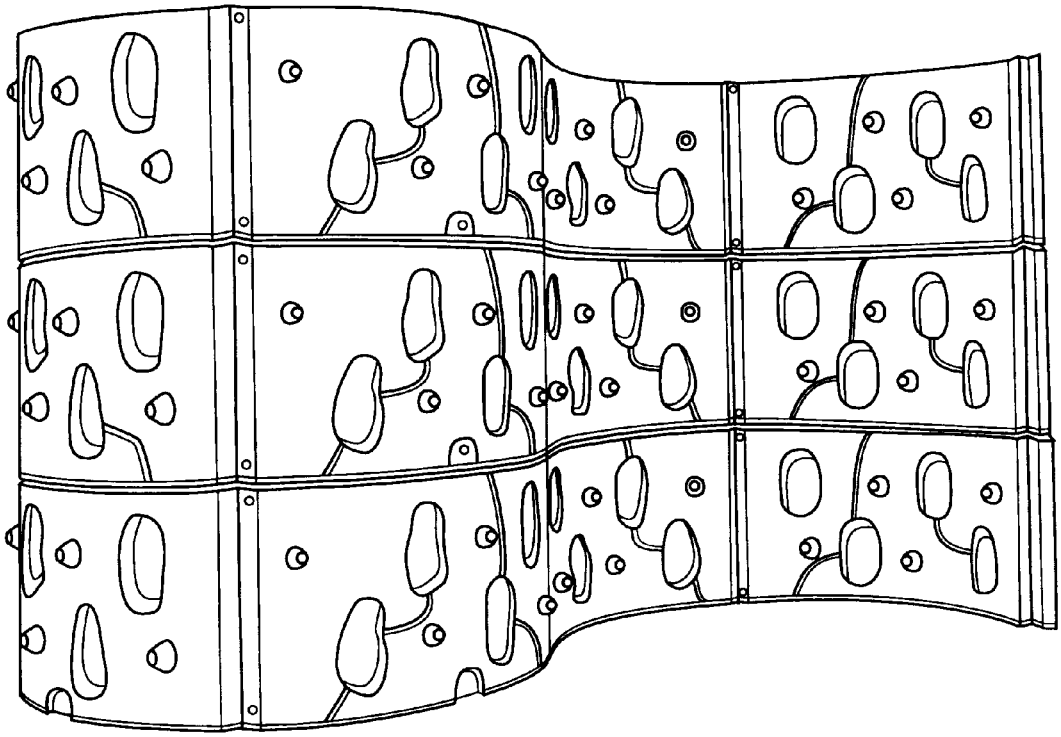
FIG. 8 is a perspective view of a curved wall configuration for playground equipment which the invention may be used to construct.

FIG. 8 illustrates an alternative configuration where a number of identical panels are connected end edge to end edge and side edge to side edge, as described above, to form a curved wall.

Figure 9:
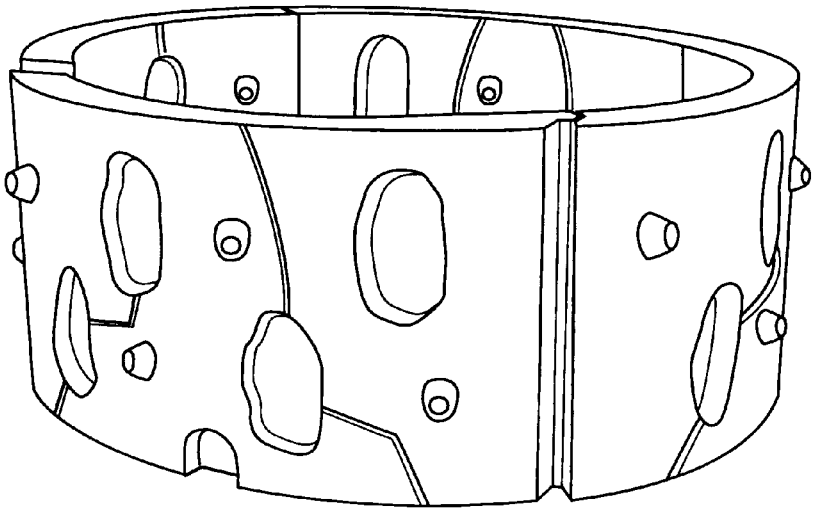
FIG. 9 is a perspective view of a circular configuration for playground equipment which the invention may be used to construct.

FIG. 9 illustrates an alternative configuration where a number of identical panels are connected edge to edge, as described above, to form a circular wall.

Figure 10:
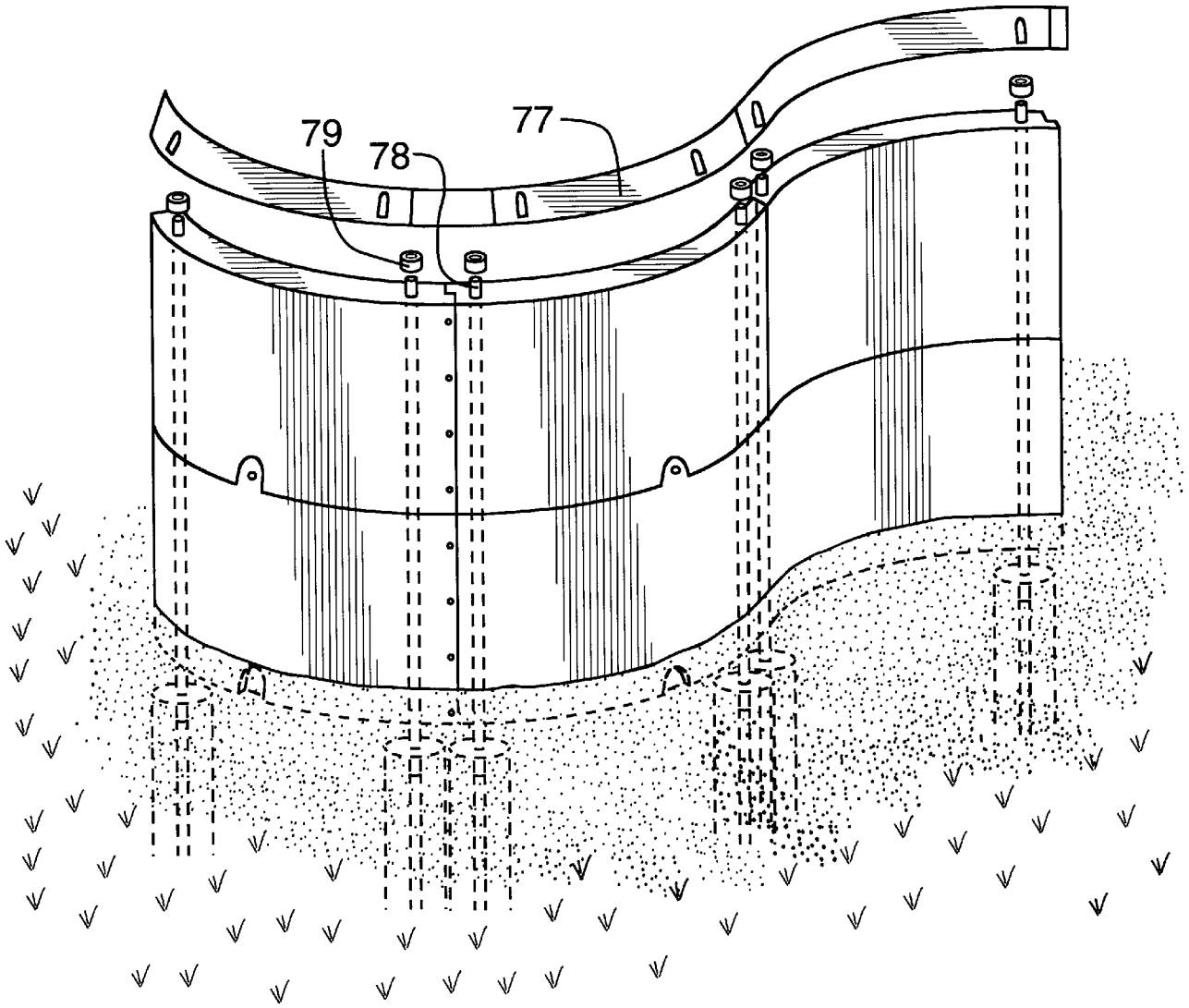
FIG. 10 is a perspective view of a curved wall, including a peaked cap.
Figure 12:
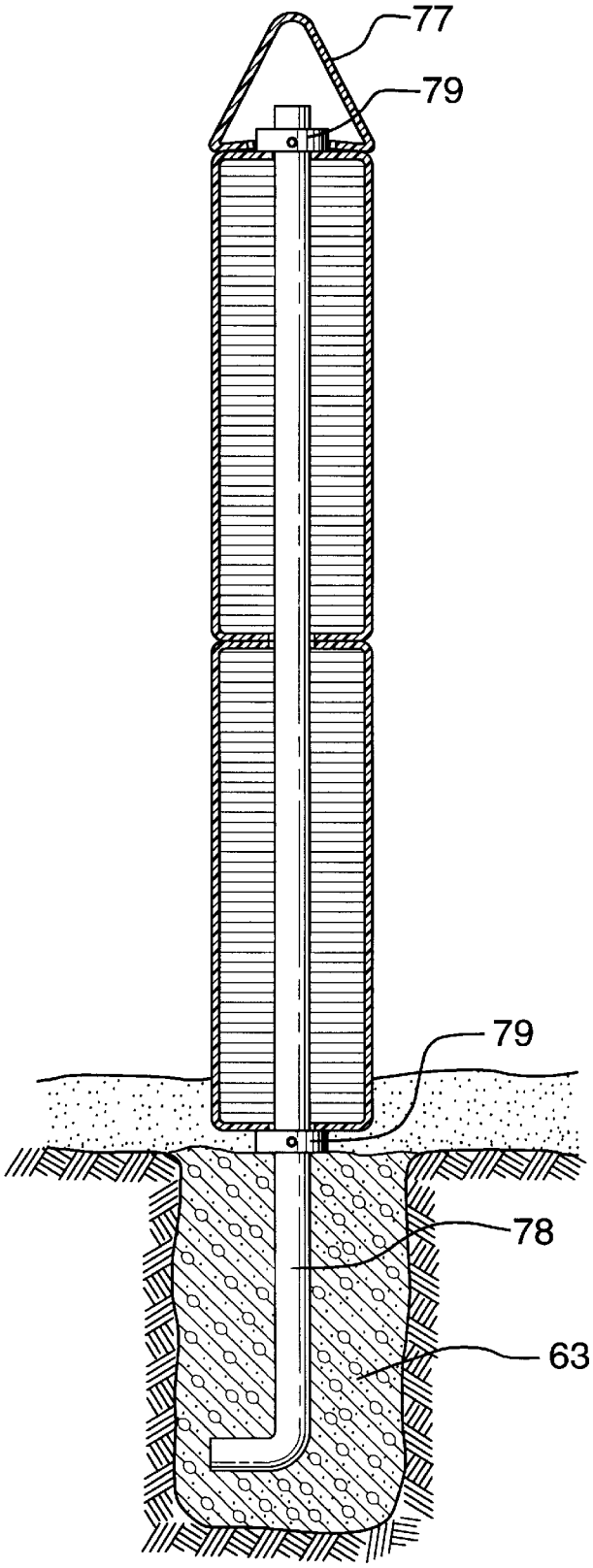
FIG. 12 is a cross-section of the wall, showing its anchoring to the ground.

FIG. 10 illustrates a wall, similar to that shown in FIG. 8, but including peaked caps 77, which are preferred, or required in some jurisdictions, to prevent children from sitting or standing on the top of the wall, for safety reasons. The wall preferably are supported by posts 78 anchored in concrete pads or foundations 63. Collars 79 are secured to the posts above and below the wall, as shown in FIG. 12, to hold the panels in place.

Figure 11:
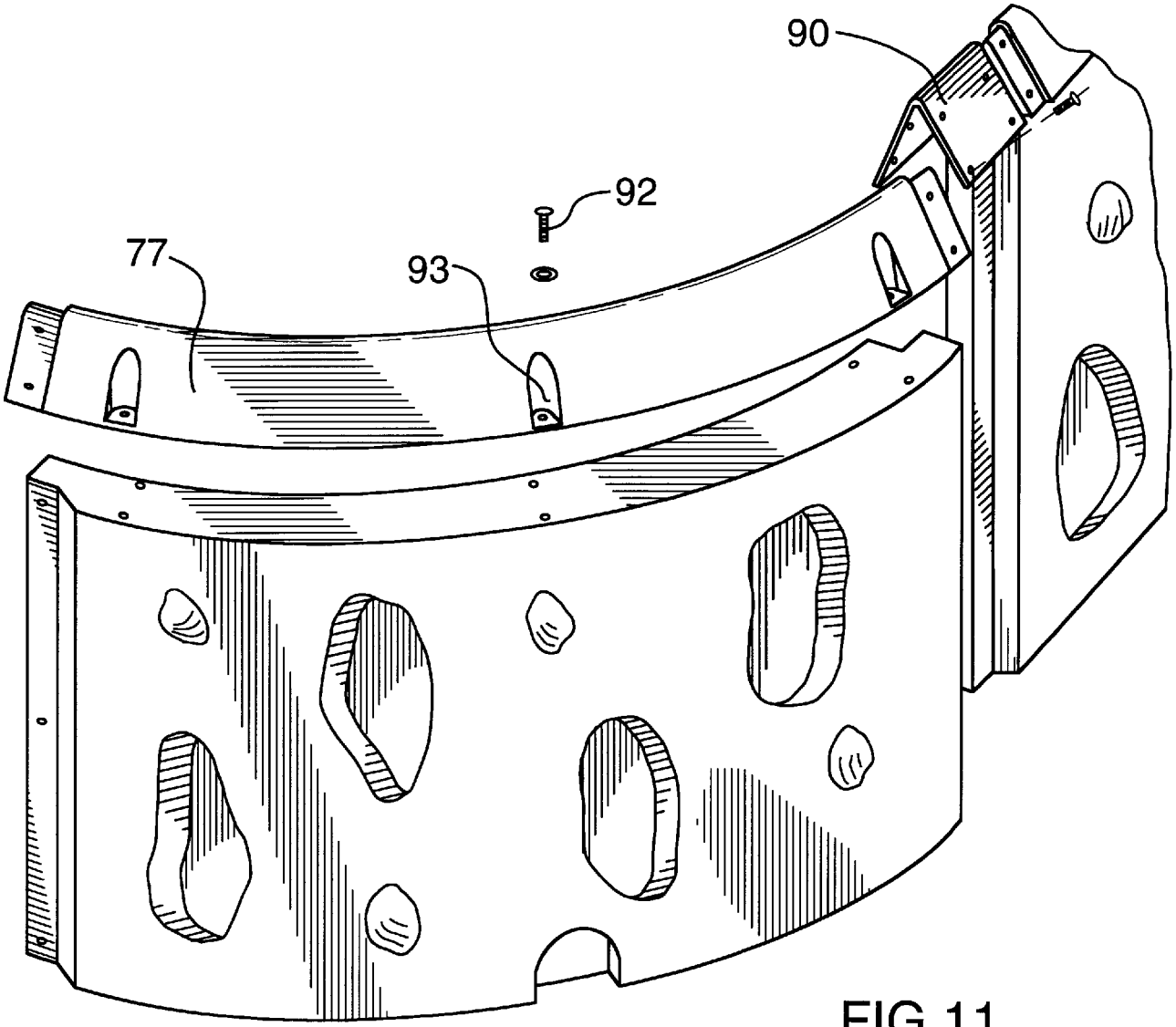
FIG. 11 is a similar perspective view, showing a little more detail.
Figure 13:
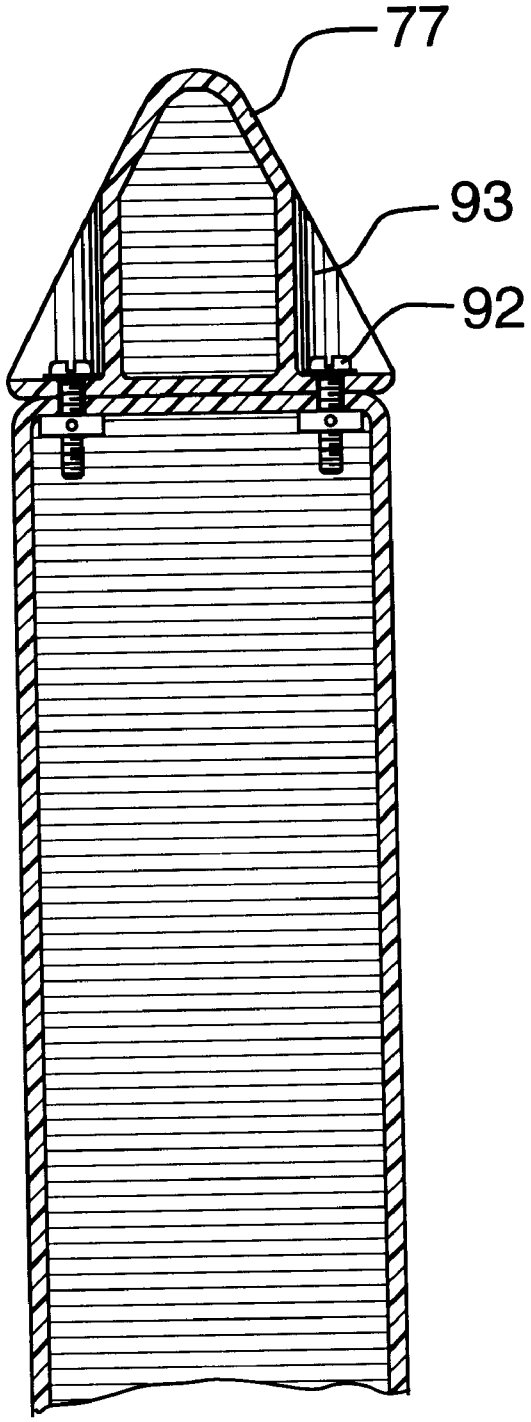
FIG. 13 is a cross-section of the upper portion of the wall, showing how the peaked cap is secured.

As seen best in FIG. 11, the peaked caps on adjacent panels are preferably connected by plates 90. As seen best in FIG. 13, the peaked caps are secured to the top of the wall by bolts 92, in recesses 93.

Figure 14:
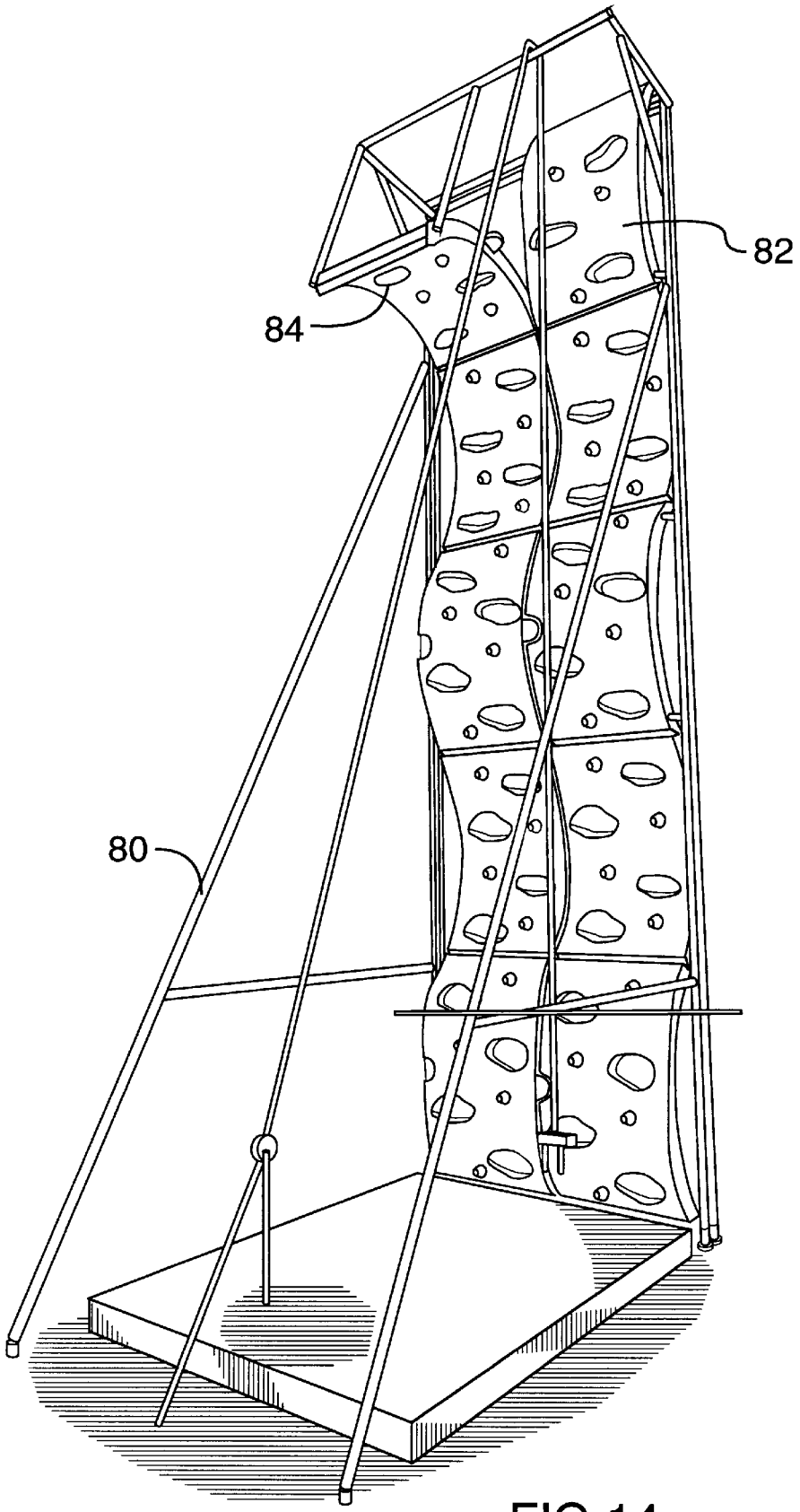
FIG. 14 is a perspective view of a large climbing wall.

FIG. 14 illustrates two columns of identical panels connected edge to edge and side to side, as described above, to form a curved vertical wall supported by, for example, a conventional metal truss 80. Each row of the wall structure is composed of two panels with curvature oriented in the same direction, but with curvature opposite to the row of panels above and below them. The top row of the wall structure is composed of two identical panels, where the right top panel 82 is oriented with its curvature opposite to the panel below it and the left top panel 84 is oriented with its curvature in the same direction as the panel below it.

Figure 15:
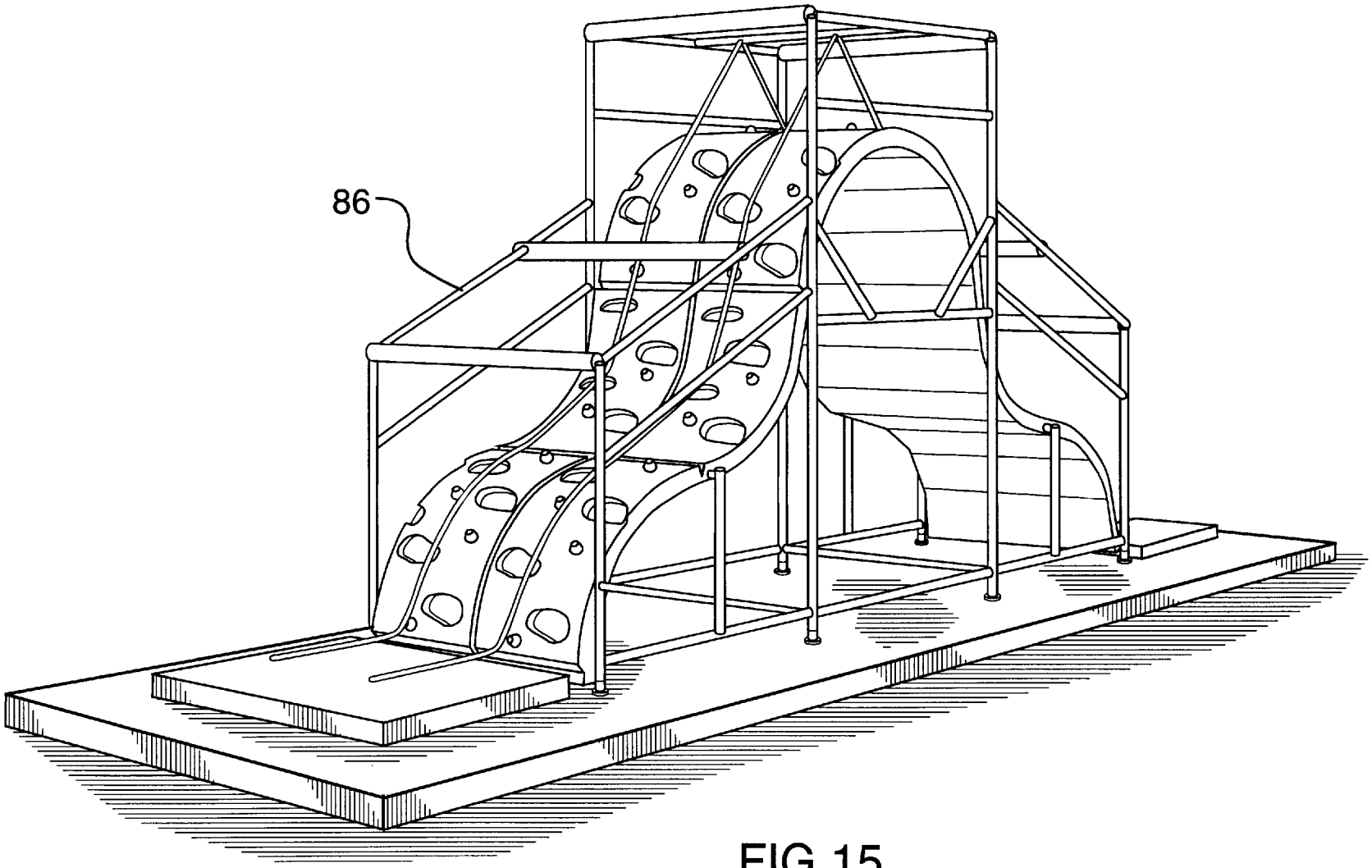
FIG. 15 is a perspective view of a miniature "mountain" built from the invention.

FIG. 15 illustrates an arrangement of identical panels in the shape of a miniature "mountain" connected in the manner described above and supported, for example, by a conventional steel truss 86.

The above description relates to preferred embodiments by way of example only. However, it should be apparent to those knowledgeable in the field that many variations are possible, without departing from the spirit of the invention. Such variations are intended to be within the scope of the invention as claimed, whether or not expressly described above.

What is claimed as the invention is:

1. A play structure building panel, comprising spaced-apart inner and outer generally parallel curved panel walls joined by side and end edges, said walls being curved about a common axis each at constant radii defining a hollow space therebetween, where at least one of said side edges and at least one of said end edges have extending and recessed portions, the recessed portions of said panel are adapted to receive the extending portions of another panel, the extending portions of said panel are adapted to be received in the recessed portions of another panel whereby a plurality of said panel may be connected to one another along at least one of said side or end edges.

2. A building panel, as defined in claim 1, wherein said curved panel walls further comprise a plurality of recesses defined within said curved panel walls, said recesses configured to facilitate climbing.

3. A building panel, as defined in claim 2, wherein said recesses located in said outer curved panel wall are located adjacent said recesses located in the said inner curved panel wall.

4. A building panel as, defined in claim 3, wherein each recess has a side wall and surface extending along the side wall spaced from the walls, the surface of at least one of said recesses in said curved outer wall and the surface of at least one of said recesses in said curved inner wall contact each other.

5. A building panel, as defined in claim 4, wherein said surfaces are fused to form an integral layer of material.

6. A building panel, as defined in claim 5, wherein said curved panel walls further comprise a plurality of recesses defined within said curved panel walls, said recesses configured to facilitate climbing.

7. A building panel, as defined in claim 6, wherein said recesses located in said outer curved panel wall are located adjacent said recesses located in the said inner curved panel wall.

8. A building panel, as defined in claim 7, wherein the surface of at least one of said recesses in said curved outer wall and the surface of at least one of said recesses in said curved inner wall contact each other.

9. A building panel, as defined in claim 8, wherein said surfaces are fused to form an integral layer of material.

10. A building panel, as defined in claim 1, wherein said curved panel walls further have a plurality of projections extending therefrom and recesses therein to facilitate climbing.

11. A building panel, as defined in claim 10, wherein said recesses located in said outer curved panel wall are located adjacent said recesses located in the said inner curved panel wall.

12. A building panel, as defined in claim 11, wherein each recess has a side wall and a surface, the surface of at least one of said recesses in said curved outer wall and the surface of at least one of said recesses in said curved inner wall contact each other.

13. A building panel, as defined in claim 12, wherein said surfaces are fused to form an integral layer of material.

14. A building panel as recited in claim 1, in combination with a peaked cap securable along one of said edges of said panel to provide a peaked top to a wall constructed using said panel.

15. A play structure building panel, comprising spaced-apart inner and outer generally parallel curved panel walls joined by side and end edges, said walls being curved about a common axis each at constant radii defining a hollow space therebetween said curved panel walls further having a plurality of projections extending therefrom and recesses therein to facilitate climbing.

16. A building panel, as defined in claim 15, wherein said recesses located in said outer curved panel wall are located adjacent said recesses located in the said inner curved panel wall.

17. A building panel, as defined in claim 16, wherein each recess has a side wall and a surface extending along the side wall spaced from the walls, the surface of at least one of said recesses in said curved outer wall and the surface of at least one of said recesses in said curved inner wall contact each other.

18. A building panel, as defined in claim 17, wherein said surfaces are fused to form an integral layer of material.

19. A building panel as recited in claim 15, in combination with a peaked cap securable along one of said edges of said panel to provide a peaked top to a wall constructed using said panel.

* * * * *